US011688379B2

(12) United States Patent
Lee et al.

(10) Patent No.: US 11,688,379 B2
(45) Date of Patent: Jun. 27, 2023

(54) PLATE BENDING WAVE ABSORBER

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 396 days.

(21) Appl. No.: 16/995,186

(22) Filed: Aug. 17, 2020

(65) Prior Publication Data

US 2022/0051650 A1 Feb. 17, 2022

(51) Int. Cl.

| | |
|---|---|
| ***G10K 11/172*** | (2006.01) |
| ***G10K 11/162*** | (2006.01) |
| ***G10K 11/175*** | (2006.01) |

(52) U.S. Cl.

CPC ..... *G10K 11/172* (2013.01); *G10K 11/162* (2013.01); *G10K 11/175* (2013.01)

(58) Field of Classification Search

CPC ... G10K 11/162; G10K 11/175; G10K 11/172
USPC ..... 181/286
See application file for complete search history.

(56) References Cited

U.S. PATENT DOCUMENTS 4,355,578 A * 10/1982 Raquet ..... F16F 7/108 238/382
4,373,608 A * 2/1983 Holmes ..... F16F 7/10 181/208
7,828,113 B1 * 11/2010 Dao ..... F16F 7/08 181/207
9,466,283 B2 10/2016 Yang et al.
10,422,398 B2 * 9/2019 Jeon ..... F16F 1/043
10,458,501 B2 * 10/2019 Harne ..... F16F 7/108
10,482,865 B2 * 11/2019 Yang ..... G10K 11/172
(Continued)

OTHER PUBLICATIONS

Yang et al., "Suppression of bending waves in a beam using resonators with different separation length", J. Acoust. Soc. Am., 139, pp. 2361-2371 (2016).

(Continued)

*Primary Examiner* — Forrest M Phillips
(74) *Attorney, Agent, or Firm* — Christopher G. Darrow; Darrow Mustafa PC

(57) ABSTRACT

An acoustic system is provided for the perfect absorption of bending waves. The acoustic system includes a longitudinally extending substrate (plate or beam) defining upper and lower opposing major surfaces. At least two mechanical resonators are coupled to the upper major surface and separated by a distance dimension that may be based on a fraction of a magnitude of the wavelength of a selected bending wave. Each mechanical resonator includes a rigid mass component and a connecting element. The mechanical resonators are configured to block or absorb bending waves that propagate through the substrate. The connecting elements maintain the rigid mass component an elevated distance from the upper major surface of the beam when in a rest position. The connecting element can be a spring and damper; a flexible rubber/plastic component with an axial stiffness; or a base connecting component with a flexible arm, optionally with vibration damping.

20 Claims, 7 Drawing Sheets

(56) References Cited

U.S. PATENT DOCUMENTS

| | | | | |
|---|---|---|---|---|
| 10,854,183 | B2 * | 12/2020 | Yamazoe | G10K 11/16 |
| 11,021,870 | B1 * | 6/2021 | McKnight | E04B 1/84 |
| 11,056,090 | B2 * | 7/2021 | Martin | G10K 11/02 |
| 11,158,299 | B2 * | 10/2021 | Chunren | G10K 11/162 |
| 2016/0027427 | A1 * | 1/2016 | Yang | G10K 11/172 181/286 |
| 2016/0071507 | A1 * | 3/2016 | Kim | E04B 1/84 181/286 |
| 2016/0104472 | A1 * | 4/2016 | Sheng | G10K 11/172 181/288 |
| 2021/0193101 | A1 * | 6/2021 | Sugiura | B32B 27/283 |

OTHER PUBLICATIONS

Leng et al., "Limits of flexural wave absorption by open lossy resonators: reflection and transmission problems", New Journal of Physics, 21, 053003 (2019) (11 pages).

Norris et al. "Non-symmetric flexural wave scattering and one-way extreme absorption", J. Acoust. Soc. Am., 146, pp. 873-883 (2019).

Peng et al., "Acoustic metamaterial plates for elastic wave absorption and structural vibration suppression", International Journal of Mechanical Sciences 89 (2014) pp. 350-361.

* cited by examiner

PLATE BENDING WAVE ABSORBER

TECHNICAL FIELD

The present disclosure generally relates to a plate bending wave absorption system and, more particularly, to a plate system decorated with mechanical resonators for perfect absorption.

BACKGROUND

The background description provided is to generally present the context of the disclosure. Work of the inventors, to the extent it may be described in this background section, and aspects of the description that may not otherwise qualify as prior art at the time of filing, are neither expressly nor impliedly admitted as prior art against the present technology.

Sound radiation caused by bending waves, or flexural waves, traveling across beams and plate structures poses a variety of issues in different environments, and is one of the main noise issues related to vehicles. For example, the bending waves may deform the beam or plate structure transversely as they propagate along the structure. While it may be desirable for beams and plates to be made of lighter materials for vehicle use, when a high strength-to-mass ratio material is provided, it generally may result in inadequate acoustic qualities. Thus, structural vibration may propagate in the form of plate bending waves, eventually leaking into the surrounding area such that certain structure-born noises can be heard.

Mechanical resonators can be used for plate bending waves or plate vibration, including reflection-type resonators and mechanical resonators with partial absorption. Perfect bending wave absorbers are useful for many application scenarios, including structure-born noise mitigation. However, perfect bending wave absorption has not been available with a plate bending wave absorption system in order to block, bend, and/or suppress the propagation of a bending wave.

Accordingly, there remains a need for improved acoustic metamaterials and bending wave absorption systems.

SUMMARY

This section generally summarizes the disclosure and is not a comprehensive disclosure of its full scope or all its features.

In one aspect, the present technology provides an acoustic plate system for the absorption of bending waves. The acoustic plate system includes a longitudinally extending base plate defining upper and lower opposing major surfaces. A plurality of mechanical resonators are provided, coupled to the upper major surface in an array pattern. Each mechanical resonator includes a rigid mass component and a connecting element. The mechanical resonators are configured to block or absorb bending waves that propagate through the longitudinally extending base plate.

In another aspect, the present technology provides an acoustic beam system for the absorption of bending waves. The acoustic beam system includes a longitudinally extending beam member defining upper and lower opposing major surfaces. At least two mechanical resonators are provided coupled to the upper major surface and aligned in a linear array along a length dimension of the longitudinally extending beam member. Each mechanical resonator includes a rigid mass component and a connecting element. The mechanical resonators are configured to block or absorb bending waves that propagate through the longitudinally extending beam member.

In yet another aspect, the present technology provides an acoustic system is provided for the absorption of bending waves. The acoustic system includes a longitudinally extending substrate, such as a plate or a beam, defining upper and lower opposing major surfaces. At least two mechanical resonators are coupled to the upper major surface and separated by a distance dimension (d) which may be based on a fraction of a magnitude of the wavelength of a selected bending wave. Each mechanical resonator includes a rigid mass component and a connecting element. The mechanical resonators are configured to block or absorb bending waves that propagate through the substrate, and the connecting elements maintain the rigid mass component an elevated distance from the upper major surface of the beam when in a rest position. The connecting element can be a spring; a flexible rubber component with an axial stiffness; or a base connecting component with a flexible arm.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The present teachings will become more fully understood from the detailed description and the accompanying drawings, wherein.

The figures set forth herein are intended to exemplify the general characteristics of the methods, algorithms, and devices among those of the present technology, for the purpose of the description of certain aspects. These figures may not precisely reflect the characteristics of any given aspect and are not necessarily intended to define or limit specific embodiments within the scope of this technology. Further, certain aspects may incorporate features from a combination of figures.

DETAILED DESCRIPTION

Vibrations through a plate or beam can generally be based (at least) on shear waves, bending waves, and longitudinal waves. The present technology provides improved acoustic metamaterials and acoustic systems for the absorption of bending waves, including demonstrating a perfect absorption based on practical designs. The acoustic system includes a longitudinally extending substrate, such as a plate or a beam, defining upper and lower opposing major surfaces. At least two mechanical resonators are coupled to the upper major surface and separated by a distance dimension (d) which may be based on a fraction of a magnitude of the wavelength of a selected bending wave. Each mechanical resonator includes a rigid mass component and a connecting element or feature. The mechanical resonators are configured to block (reflect) or absorb bending waves that propagate through the substrate, and the connecting elements maintain the rigid mass component an elevated distance from the upper major surface of the beam when in a rest position. As will be discussed in more detail below, the connecting element can be a spring; a flexible rubber component with axial stiffness; or a base connecting component with a flexible arm, optionally with another dampening material.

Figure 1A:
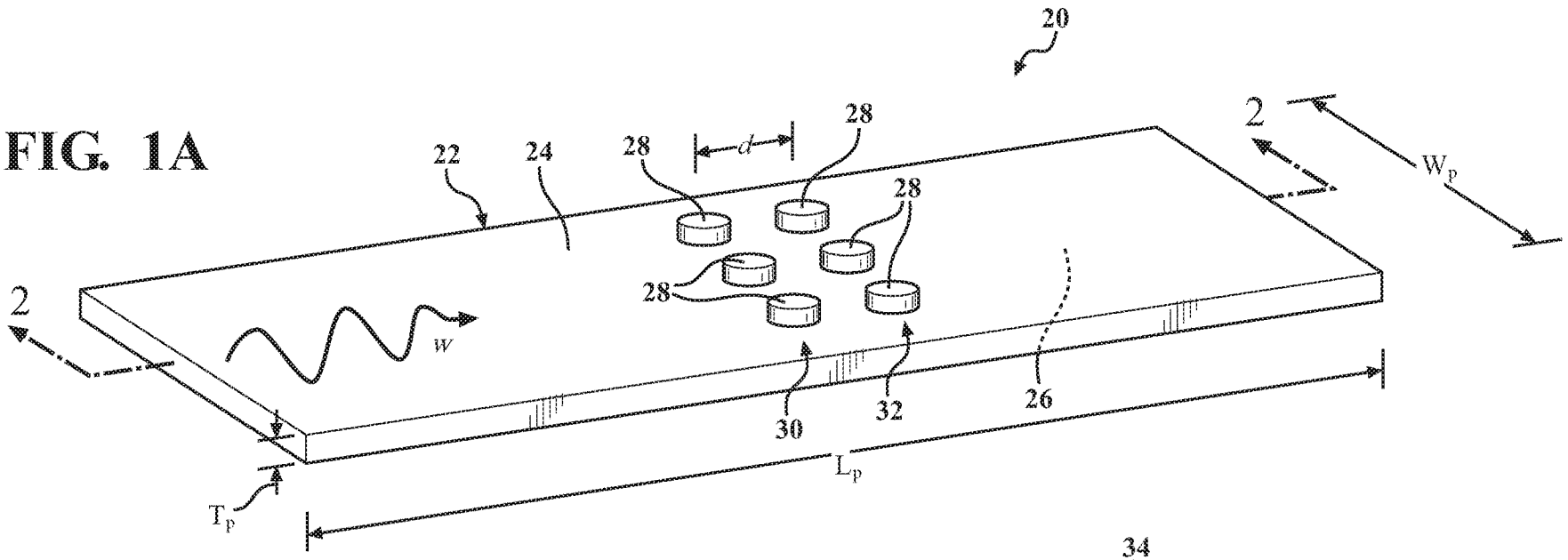
FIG. 1A illustrates one non-limiting example of an acoustic structure for suppressing the propagation of a bending wave and includes a thin plate structure decorated with a plurality of mechanical resonators arranged in two linear arrays.

FIG. 1A illustrates one non-limiting example of an acoustic structure 20 for suppressing the propagation of a bending wave w, and includes a longitudinally extending substrate provided as a thin, longitudinally extending base plate 22 structure. The longitudinally extending base plate 22 has a plate length, $L_p$, a plate thickness, $T_p$, and a plate width, $W_p$, and defines an upper major surface 24 and an opposite lower major surface 26. The upper major surface 24 is shown decorated with a plurality of mechanical resonators 28 arranged in two spaced-apart linear arrays 30, 32, spaced apart by a distance, d. This configuration may be referred to as a dual-resonator system. In various aspects, one or more of the different linear arrays 30, 32 may be designed to have a different resonance frequency. While the arrays 30, 32 illustrate each of the mechanical resonators 28 being aligned with one another in the longitudinal direction, there may be instances where there is a certain degree of staggering of the mechanical resonators from one array to another, for example, being staggered a distance less than about 0.2d. It should be understood that FIG. 1A illustrates two arrays of three mechanical resonators 28 for purposes of simplicity and clarity, and the actual number of arrays and mechanical resonators 28 may vary based on the design. In various aspects, the plate thickness dimension, $T_p$, of the longitudinally extending base plate 22 is generally less than a wavelength dimension (λ) of the bending wave w, for example, the thickness may be less than about 0.1λ. In various aspects, the mechanical resonators 28 in each array may be identical resonators with respect to the structure and properties, while the mechanical resonators 28 in different arrays may have a different structure and/or properties.

Figure 1B:
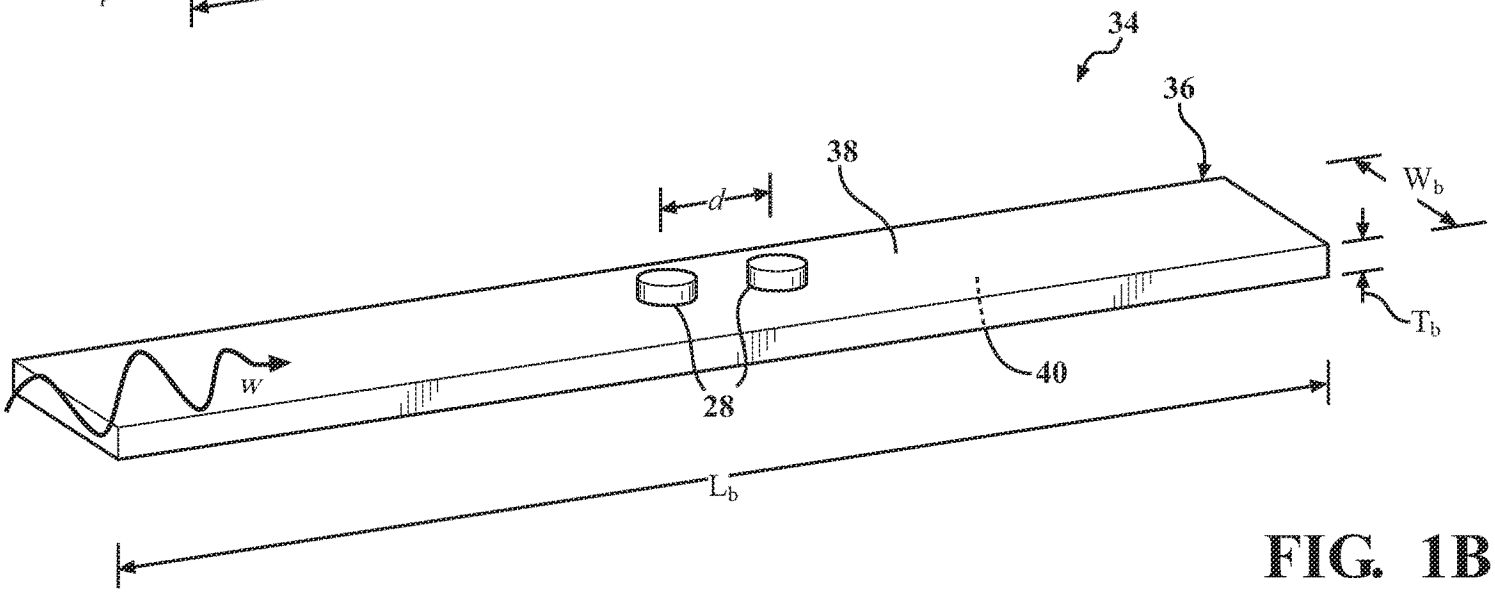
FIG. 1B illustrates another non-limiting example of an acoustic structure for suppressing the propagation of a bending wave and includes a beam structure decorated with at least two spaced-apart mechanical resonators.

FIG. 1B illustrates another non-limiting example of an acoustic structure 34 for suppressing the propagation of a bending wave w and includes a longitudinally extending substrate provided as a thin, longitudinally extending beam 36 structure. The longitudinally extending beam 36 has a beam length, $L_b$, a beam thickness, $T_b$, and a beam width, $W_b$, and defines an upper major surface 38 and an opposite lower major surface 40. In certain regards, the representation of FIG. 1B can be considered a unit cell, for example, where FIG. 1A includes three unit cells of FIG. 1B. The upper major surface 38 is shown decorated as a dual-resonator system with two mechanical resonators 28, similarly spaced-apart by a distance, d. In beam structures 34 with a pair of mechanical resonators 28, the beam width $W_b$ should be smaller than the wavelength dimension. If the beam width $W_b$ is larger than the wavelength, additional pairs of resonators may need to be added in order to keep the periodicity smaller than the wavelength. In various aspects, the beam thickness dimension, $T_b$, of the longitudinally extending beam 36 is also less than a wavelength dimension (λ) of the bending wave w, for example, the thickness may be less than about 0.1λ.

Figure 2A:
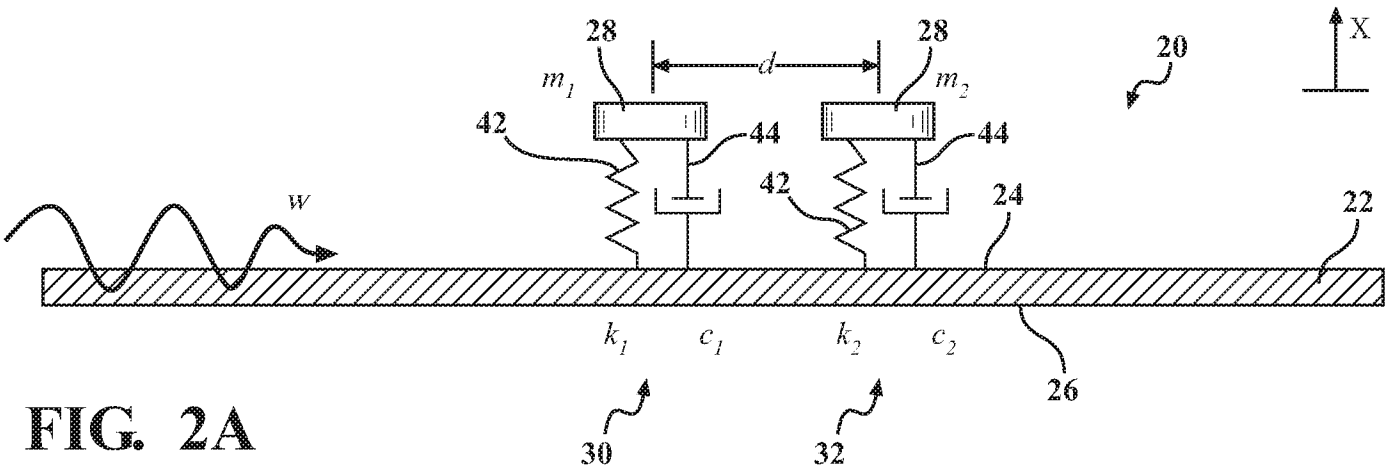
FIG. 2A is a cross-sectional view of the acoustic structure of FIG. 1 taken along the line 2-2.

FIG. 2A is a cross-sectional view of the acoustic structure of FIG. 1 taken along the line 2-2. FIG. 2A specifically illustrates each mechanical resonator 28 as a single degree of freedom (SDOF) spring-mass-damper system that includes a spring 42 and a damper 44 securing a rigid mass component m to the longitudinally extending base plate 22; where k is the spring constant, and c is the damping coefficient. Exemplary values for m and k may vary based on the frequency, governed by the equations provided below. Motion is defined by one independent coordinate, such as time. The spring constant, k, represents the force exerted by the spring when it is compressed for a unit length. The damping coefficient, c, represents the force exerted by the damper when the rigid mass m moves at a unit speed. In response to the force from the bending wave w travelling in the longitudinal direction, the rigid mass, m, is free to move along the x-axis, and any time the rigid mass m moves, the motion is resisted by the spring 42 and the damper 44. As the rigid mass m moves down a certain distance, it compresses the spring 42 and moves the damper 44 by the same distance. The spring 42 stores and releases energy during one cycle. The damper 44 absorbs energy and doesn't release it back to the rigid mass m. The equation representative of this system is a second-order, ordinary differential equation and can be represented as:

$$\frac{d^2x}{dt^2} + 2\zeta\omega_0\frac{dx}{dt} + \omega_0^2 x = 0$$

where t is time, and the natural frequency, in radians, is provided as:

$$\omega_0 = \sqrt{\frac{k}{m}}$$

and the damping ratio is provided as $$\zeta = \frac{c}{2\sqrt{mk}}$$

In this regard, the damping ratio can also be represented by the ratio of the actual damping coefficient to the critical damping coefficient. Thus, $$\zeta = \frac{c}{c_c}$$

where the critical damping coefficient is provided as:

$$c_c = 2\sqrt{km}$$

Notably, a damped system returns to rest in different ways, which is generally determined by the damping ratio. A damping ratio that is greater than 1 indicates an overdamped system, which returns to rest slowly without oscillations. A damping ratio that is less than 1 indicates an underdamped system, which returns to rest in an oscillatory fashion. A damping ratio equal to 1 is a critically damped system, which returns to rest quickly without oscillating.

In various aspects of the present technology, the rigid mass m of each resonator can be equal to one another, such that $m_1=m_2=m_3$, etc. With respect to the spring constant k of the mechanical resonators in adjacent arrays, in various aspects, the spring constant $k_1$ of the first array 30 (the first array to be contacted by the bending wave w) is provided with a magnitude greater than the spring constant $k_2$ of the second array 32, thus $k_1>k_2$. In one example, $k_1$ is approximately 0.8 $k_2$. In instances where $k_1=k_2$, the acoustic structure may suppresses the vibration (i.e., absorption>80%).

As shown in FIGS. 1A, 1B, and 2A, in various aspects, each linear array 30, 32 of mechanical resonators 28 may be separated by a distance dimension (d) from about 0.35 k to about 0.45λ, or about 0.4λ, where λ is the wavelength of the bending wave w. In certain aspects where two linear arrays 30, 32 are provided, it can be beneficial where the damping coefficient $c_2$ of the second array 32 (second, or last, to be contacted by the bending wave w) is less than the damping coefficient $c_1$ of the first array 30. In certain instances, the system 20 may be provided with an asymmetric loss between arrays, for example, with a first array 30 of lossy mechanical resonators, and a second array 32 of lossless mechanical resonators (no damping) where the damping coefficient $c_2$ is zero (0) in order to have ideal conditions to obtain perfect absorption. In various aspects, $c_2$ may be a non-zero value, and in certain examples, $c_2<0.1c_1$ for high absorption (i.e., absorption>90%). In aspects where $c_2=c_1$ symmetry damping, absorption of about 80% can be obtained.

Figure 2B:
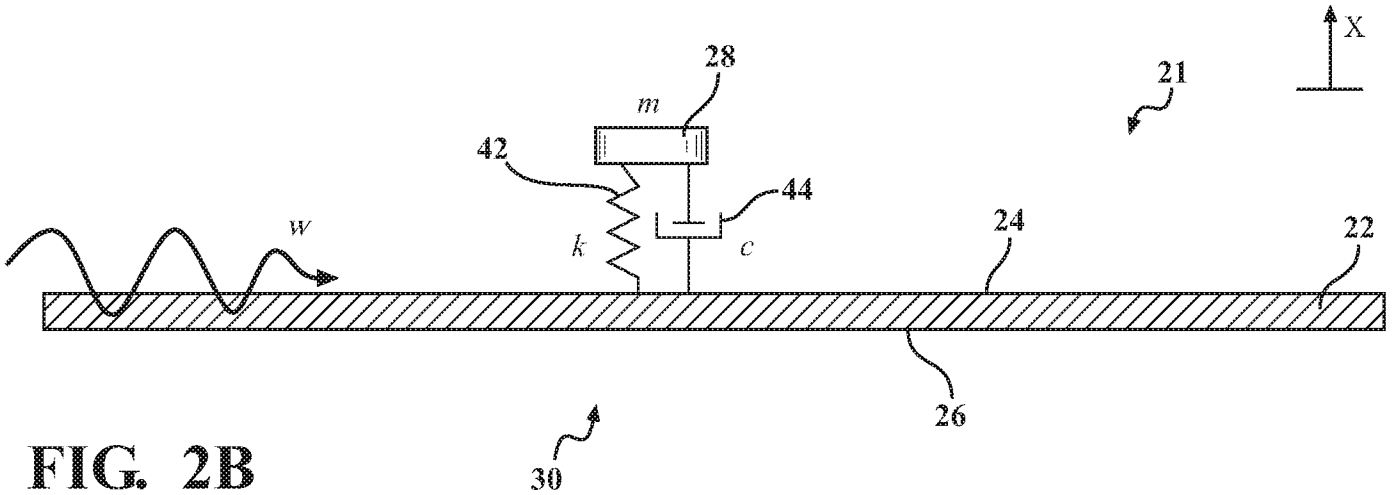
FIG. 2B is a cross-sectional view of an alternative design of the acoustic structure of FIG. 1 taken along the line 2-2, providing only a single array.

FIG. 2B is a cross-sectional view of an alternative design of the acoustic structure of FIG. 1 taken along the line 2-2, providing only a single array of mechanical resonators 28. This configuration may be referred to as a single-resonator system.

The types of connecting elements and mechanical resonator designs useful with the present technology can take various forms and it is envisioned that they can be easily customized for different designs. FIGS. 3-6 provide non-limiting examples of different connecting elements and mechanical resonator designs that may be useful with the present technology. While the following descriptions may generally refer to the mechanical resonators 28 being coupled to a longitudinally extending base plate 22 as the substrate, the technology is also applicable to beam 36 structure designs. The mechanical resonators 28 may be attached together to the respective connecting elements and base plate 22 or beam 26 structures through any one of a number of different attachment means know to those of ordinary skill in the art, such as adhesives, press form fittings, screw-type fittings, fasteners, clamps, or any other methodology for joining one or more separate pieces together. In the various aspects described in FIGS. 3-6, the different arrays can similarly be provided as lossy or lossless resonators, or with different damping properties as described above with respect to the spring type mechanical resonator.

Figure 3:
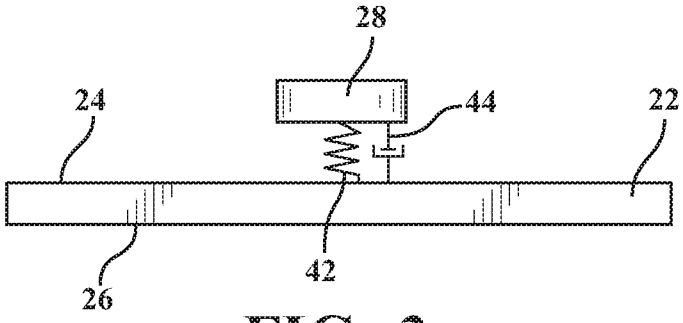
FIG. 3 illustrates a first aspect of a mechanical resonator including a rigid material coupled to the plate with a mechanical spring and damper.

FIG. 3 illustrates a first aspect of a connecting element of the present technology, providing a mechanical resonator 28 including a rigid material m coupled to an upper surface 24 of the longitudinally extending base plate 22 with a mechanical spring 42 and damper 44 as connecting elements. The specific details of this design are discussed above with respect to FIG. 2A, where the spring 42 and optional damper 44 maintain the rigid mass component m at an elevated distance from the upper major surface 24 of the longitudinally extending base plate 22 when in a rest position.

Figure 4:
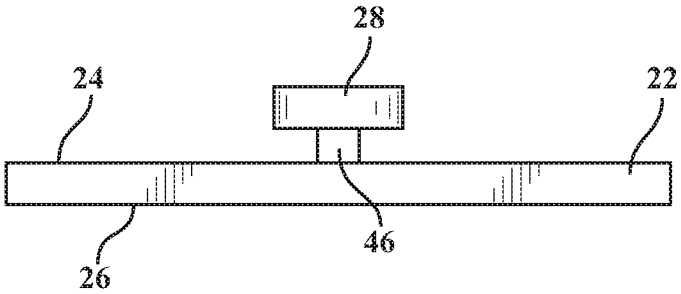
FIG. 4 illustrates a second aspect of a mechanical resonator including a rigid material coupled to the plate with a soft material, such as a rubber or plastic component with an axial stiffness.

FIG. 4 illustrates a second aspect of a connecting element of the present technology, providing a mechanical resonator 28 including a rigid material m coupled to an upper surface 24 of the longitudinally extending base plate 22 with a less rigid, or soft material component 46 as the connecting element. In various aspects, the soft material component 46 can be a flexible rubber or plastic component with an axial stiffness that can be easily customized based on the specific material selection. The flexible rubber or plastic material component 46 is provided configured for securing the rigid mass component m to the base plate 22, and maintaining the rigid mass component m at an elevated distance from the upper major surface 24 of the longitudinally extending base plate 22 when in a rest position. In various aspects, the soft material component 46 is the same composition for the mechanical resonators in each array, and different arrays may use different material compositions for the soft material component 46 in order to customize the acoustic system, for example, to provide the individual arrays of mechanical resonators with a different resonant frequency.

Figure 5:
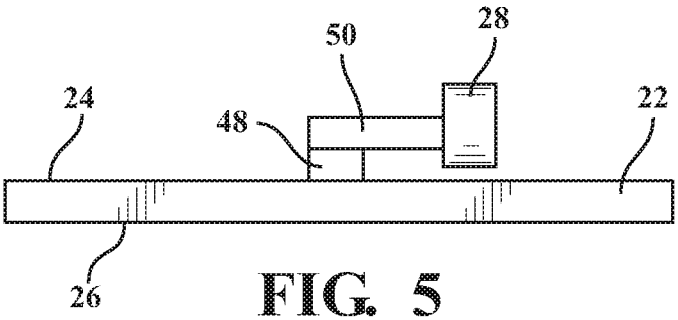
FIG. 5 illustrates a third aspect of a mechanical resonator including a rigid material coupled to the plate with a less rigid, angled connecting element.

FIG. 5 illustrates a third aspect of a connecting element of the present technology, providing a mechanical resonator 28 including a rigid material m coupled to an upper surface 24 of the longitudinally extending base plate 22 with an angled connecting element 47 that may be used to provide a customized bending stiffness. This angled connecting element 47 may be made of a thin metal, rubber, or plastic, and include a base component 48 portion and a flexible arm 50 portion extending from the base component 48 portion and coupled to the rigid material m. For example, the flexible arm 50 may be angled with respect to the base component 48 (shown in FIG. 5 at an angle of 90 degrees with respect to the base component 48 and parallel to the base plate 22) and is configured to move up and down in an angular direction/movement with respect to the base component 48. In various aspects, the angled connecting element 47 can be designed as a single structural component that couples the rigid material m to the base plate 22, or designed such that the base component 48 portion and a flexible arm 50 portion are different materials. If different materials, the base component 48 may be secured to both the longitudinally extending base plate 22 and the flexible arm 50, which has an opposite end that is secured to the rigid mass component m, configured for maintaining the rigid mass component m at an angled elevated distance from the upper major surface 24 of the longitudinally extending base plate 22 when in a rest position.

Figure 6:
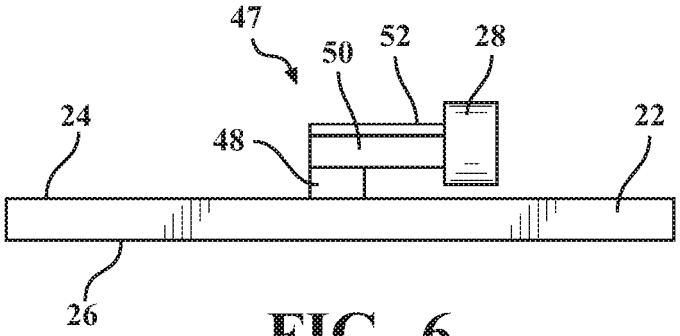
FIG. 6 illustrates a fourth aspect of a mechanical resonator including a rigid material coupled to the plate with a less rigid connecting element coupled with a damping material.

FIG. 6 illustrates a fourth aspect of a connecting element of the present technology that is similar to the angled connecting element 47 of FIG. 5, but is further customized to additionally include a damping material 52, such as rubber, plastic, polyurethane, PVC, coupled to the angled connecting element 47. In various aspects, the damping material 52 can be coupled to at least one region or area of the angled connecting element 47. For example, the damping material 52 can be secured to the flexible arm 50. In certain aspects, the damping materials 50 can be provided as a coating on at least a portion of the flexible arm 50. The properties of certain damping materials may be characterized as loss factor of from about 0.02 to about 0.1.

Examples

Various aspects of the present disclosure are further illustrated with respect to the following Examples. It is to be understood that these Examples are provided to illustrate specific aspects of the present disclosure and should not be construed as limiting the scope of the present disclosure in or to any particular aspect.

Figure 7:
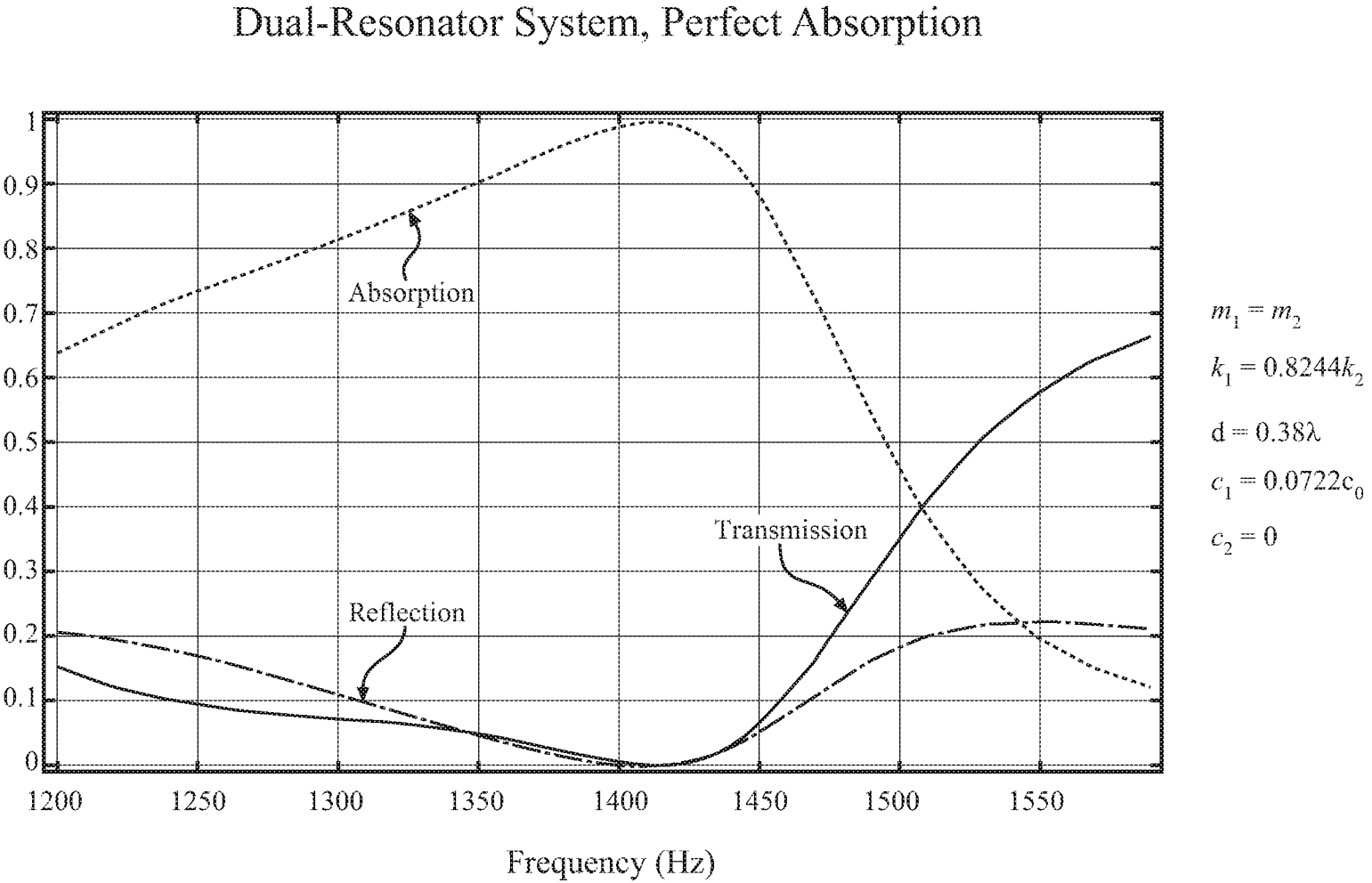
FIG. 7 illustrates a plot of absorption, reflection, and transmission for a dual-resonator system with perfect absorption according to the present teachings.

FIG. 7 illustrates a plot of absorption, reflection, and transmission for an exemplary dual-resonator system with perfect absorption according to the present teachings. For this particular example, each resonator has the same mass ($m_1=m_2$), slightly different stiffness, and an asymmetric loss with the first array being lossy resonators and the second array being lossless resonators. As shown, the perfect absorption is attainable at a frequency of about 1420 Hz.

Figure 8A:
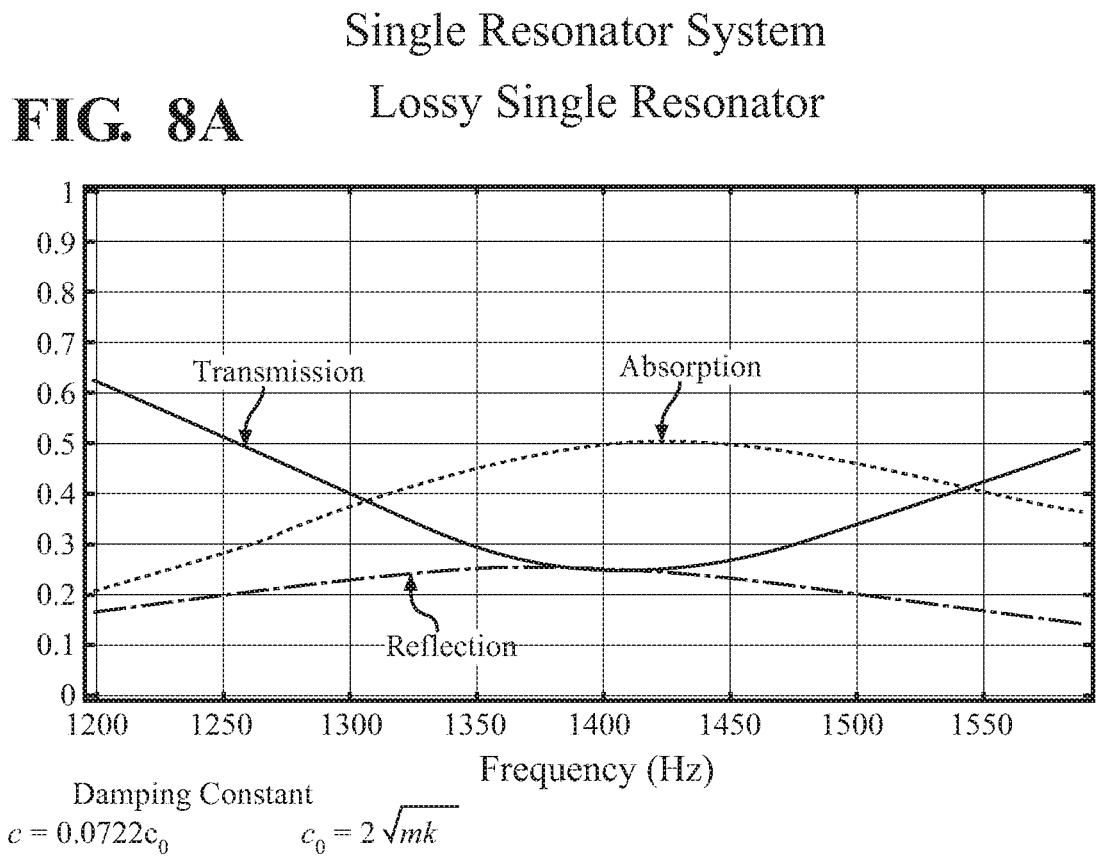
FIG. 8A illustrates a plot of absorption, reflection, and transmission for a single-resonator system with a lossy single resonator.
Figure 8B:
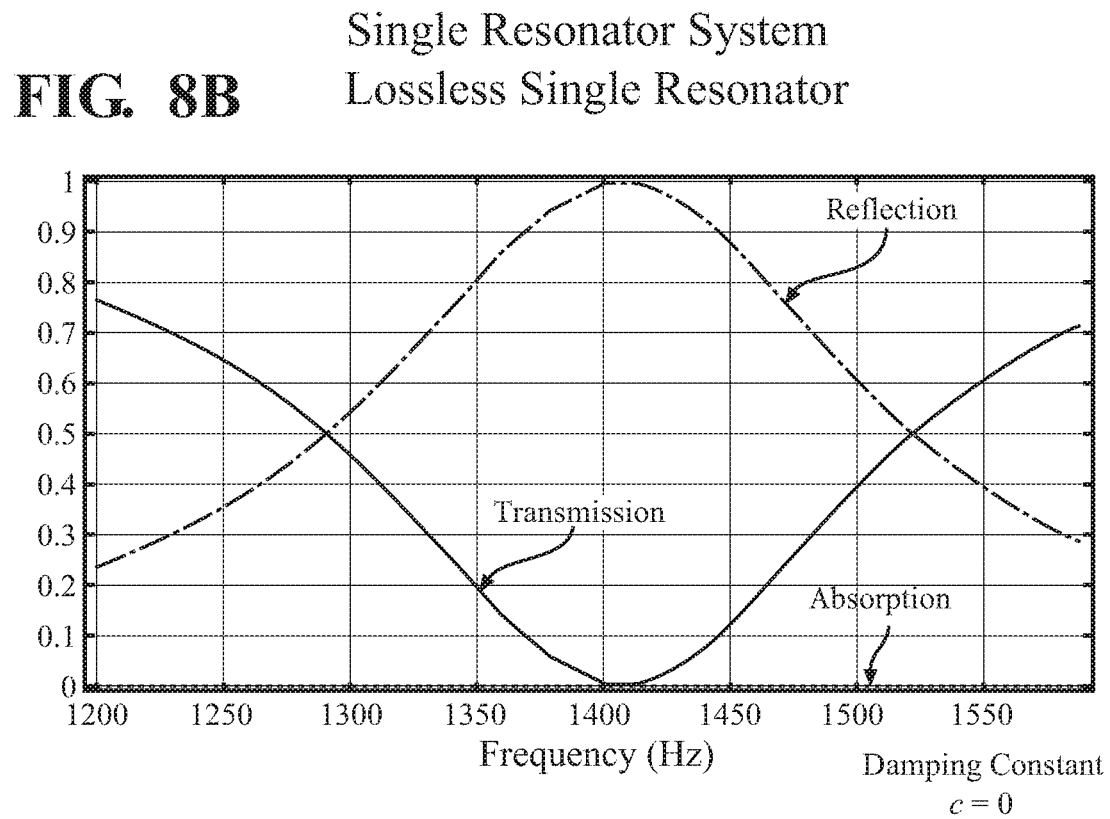
FIG. 8B illustrates a plot of absorption, reflection, and transmission for a single-resonator system with a lossless single resonator.

To illustrate the difference between dual and single resonator systems, FIG. 8A illustrates a plot of absorption, reflection, and transmission for a single-resonator system with a lossy single resonator according to the present teachings, and FIG. 8B illustrates a plot of absorption, reflection, and transmission for a single-resonator system with a lossless single resonator. The single resonator system can provide either 50% absorption at a frequency of about 1420 Hz (FIG. 8A), or perfect reflection at a frequency of about 1420 Hz (FIG. 8B).

Figure 9A:
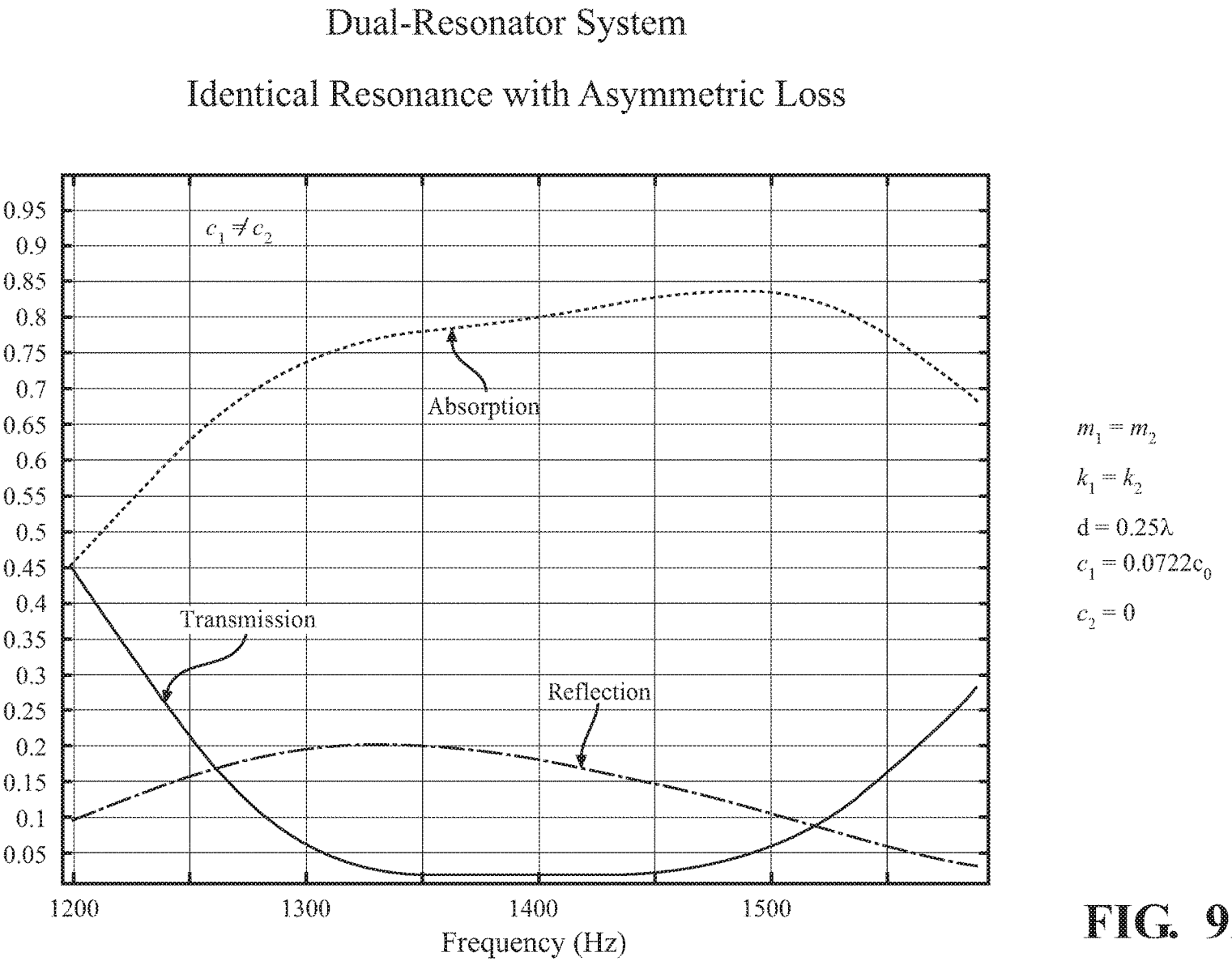
FIG. 9A illustrates a plot of absorption, reflection, and transmission for a dual-resonator system with identical resonance and asymmetric loss.
Figure 9B:
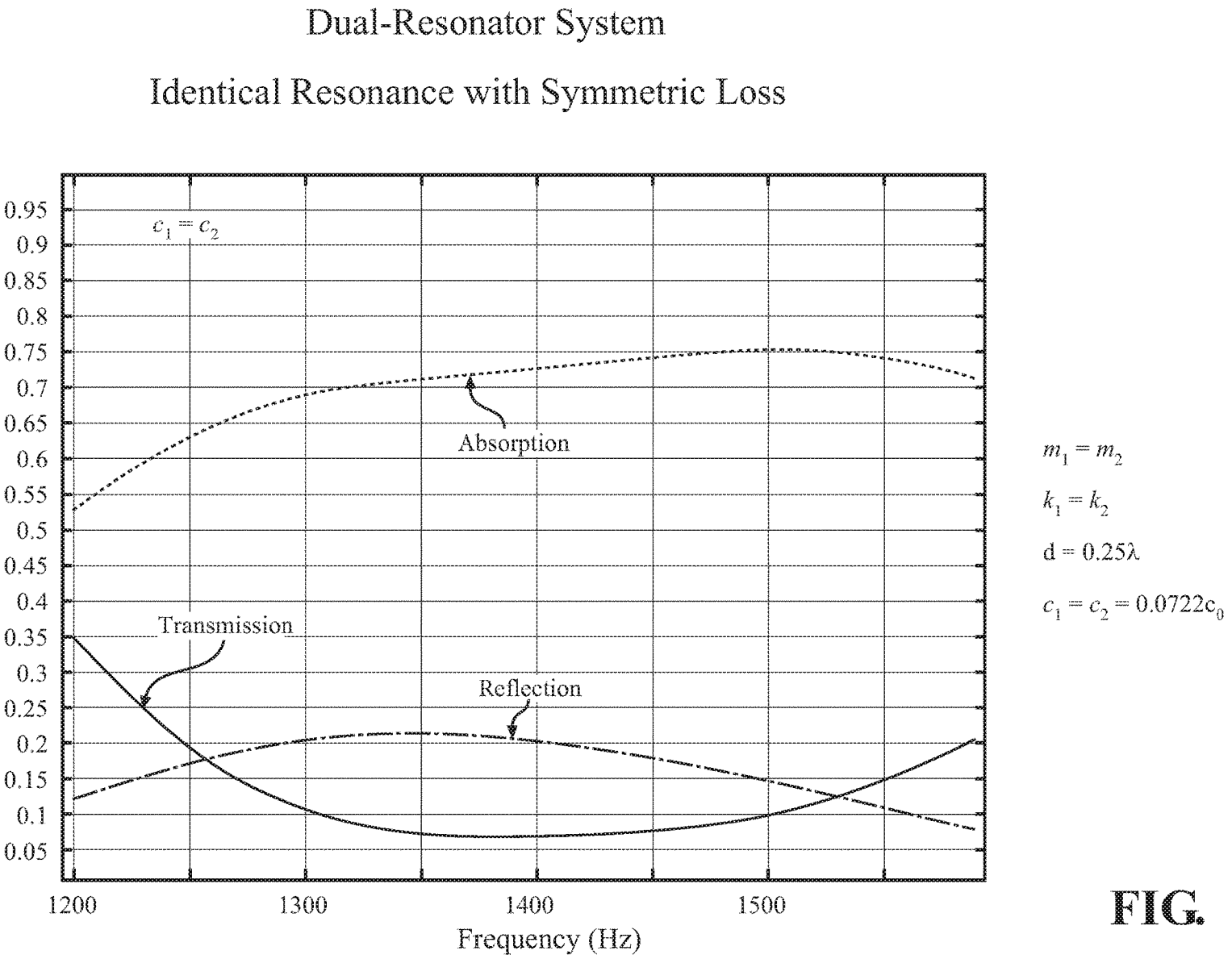
FIG. 9B illustrates a plot of absorption, reflection, and transmission for a dual-resonator system with identical resonance and symmetric loss.

Lastly, in order to provide a better understanding of the mechanism of an optimal design with arrays of different resonance, FIG. 9A illustrates a plot of absorption, reflection, and transmission for a dual-resonator system with arrays of identical resonance (same stiffness) and asymmetric loss. A maximum of only about 85% absorption can be reached near 1500 Hz. FIG. 9B illustrates a plot of absorption, reflection, and transmission for a dual-resonator system with arrays of identical resonance and symmetric loss. A maximum of only about 75% absorption can be reached near 1500 Hz.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should also be understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. An acoustic plate system for the absorption of bending waves, the acoustic plate system comprising:

a longitudinally extending base plate defining upper and lower opposing major surfaces; and a plurality of mechanical resonators coupled to the upper major surface in an array pattern with a plurality of discrete connecting elements, each mechanical resonator comprising a rigid mass component and one of the plurality of discrete connecting elements, the mechanical resonators being configured to block or absorb bending waves that propagate longitudinally through the longitudinally extending base plate.

2. The acoustic plate system according to claim 1, wherein the plurality of mechanical resonators are aligned on the upper surface in at least two spaced-apart linear arrays, each array being provided with a different resonance.

3. The acoustic plate system according to claim 2, wherein each linear array is separated by a distance dimension (d) of about 0.4λ, where λ is the wavelength of the bending wave.

4. The acoustic plate system according to claim 1, wherein the plurality of mechanical resonators are aligned in a single linear array.

5. The acoustic plate system according to claim 1, wherein the one of the plurality of discrete connecting elements of each of the plurality of mechanical resonators comprises a spring member and a damper, the spring member securing the rigid mass component to the longitudinally extending base plate, and maintaining the rigid mass component at an elevated distance from the upper major surface of the longitudinally extending base plate when in a rest position.

6. The acoustic plate system according to claim 1, wherein the one of the plurality of discrete connecting elements of each of the plurality of mechanical resonators comprises a flexible rubber or plastic component with an axial stiffness, the flexible rubber or plastic component securing the rigid mass component to the base plate, and maintaining the rigid mass component at an elevated distance from the upper major surface of the longitudinally extending base plate when in a rest position.

7. The acoustic plate system according to claim 1, wherein the one of the plurality of discrete connecting elements of each of the plurality of mechanical resonators comprises an angled connecting element with a base component and a flexible arm extending from the base component, wherein the base component is secured to the longitudinally extending base plate, and the flexible arm is secured to the rigid mass component, and maintaining the rigid mass component at an angled elevated distance from the upper major surface of the longitudinally extending base plate when in a rest position.

8. The acoustic plate system according to claim 7, further comprising a damping material coupled to the flexible arm.

9. The acoustic plate system according to claim 8, wherein the damping material is a coating on at least a portion of the flexible arm.

10. The acoustic plate system according to claim 1, wherein a thickness dimension of the longitudinally extending base plate is less than a wavelength dimension ($\lambda$) of the bending wave.

11. An acoustic beam system for the absorption of bending waves, the acoustic beam system comprising:

a longitudinally extending beam member defining upper and lower opposing major surfaces; and at least two mechanical resonators coupled to the upper major surface and aligned in a linear array along a length dimension of the longitudinally extending beam member, each mechanical resonator comprising a rigid mass component and a discrete connecting element, wherein the mechanical resonators are configured to block or absorb bending waves that propagate longitudinally through the longitudinally extending beam member.

12. The acoustic beam system according to claim 11, wherein each mechanical resonator in the linear array is separated by a distance dimension (d) of about $0.4\lambda$, where $\lambda$ is the wavelength of the bending wave.

13. The acoustic beam system according to claim 11, wherein the discrete connecting element of each mechanical resonator comprises a spring member and damper, the spring member securing the rigid mass component to the beam, and maintaining the rigid mass component at an elevated distance from the upper major surface of the longitudinally extending beam member when in a rest position.

14. The acoustic beam system according to claim 11, wherein the discrete connecting element of each mechanical resonator comprises a flexible rubber or plastic component with an axial stiffness, wherein the flexible rubber or plastic component secures the rigid mass component to the beam and maintains the rigid mass component at an elevated distance from the upper major surface of the longitudinally extending beam member when in a rest position.

15. The acoustic beam system according to claim 11, wherein the discrete connecting element of each mechanical resonator comprises an angled connecting element with a base connecting component and a flexible arm extending from the base connecting component, wherein the base connecting component is secured to the beam member, and the flexible arm is secured to the rigid mass component and maintains the rigid mass component at an angled elevated distance from the upper major surface of the longitudinally extending beam member when in a rest position.

16. The acoustic beam system according to claim 15, further comprising a damping material coupled to the flexible arm.

17. The acoustic beam system according to claim 16, wherein the damping material is a coating on at least a portion of the flexible arm.

18. An acoustic system for the absorption of bending waves, the acoustic system comprising:

a longitudinally extending substrate defining upper and lower opposing major surfaces; and at least two identical mechanical resonators coupled to the upper major surface and separated by a distance dimension (d) of about $0.4\lambda$, where $\lambda$ is the wavelength of a selected bending wave, each mechanical resonator comprising a discrete connecting element with a rigid mass component and a connecting element, wherein the mechanical resonators are configured to block or absorb bending waves that propagate longitudinally through the substrate, and the discrete connecting element maintains the rigid mass component an elevated distance from the upper major surface of the longitudinally extending substrate when in a rest position.

19. The acoustic system according to claim 18, wherein the longitudinally extending substrate is shaped as a plate or a beam and has a thickness dimension less than the wavelength dimension of the selected bending wave.

20. The acoustic system according to claim 19, wherein the discrete connecting element of each mechanical resonator comprises one of:

a spring and damper;

a flexible rubber or plastic component with an axial stiffness; and an angled connecting element with a base connecting component and a flexible arm extending at an angle from the base connecting component.

* * * * *